US005409809A

United States Patent [19]

Fabricius et al.

[11] Patent Number: 5,409,809

[45] Date of Patent: Apr. 25, 1995

[54] SILVER HALIDE EMULSIONS STABILIZED WITH IMPROVED ANTIFOGGANTS

[75] Inventors: Dietrich M. Fabricius, Hendersonville; Allan R. Schoenberg, Asheville, both of N.C.

[73] Assignee: E. I. Du Pont de Nemours and Company, Wilmington, Del.

[21] Appl. No.: 224,124

[22] Filed: Apr. 6, 1994

Related U.S. Application Data

[63] Continuation of Ser. No. 955,550, Oct. 1, 1992, abandoned.

[51] Int. Cl.[6] ..... G03C 1/34

[52] U.S. Cl. ..... 430/611; 430/614

[58] Field of Search ..... 430/611, 614

[56] References Cited

U.S. PATENT DOCUMENTS

| | | | |
|---|---|---|---|
| 3,704,130 | 11/1972 | Pollet et al. | 430/642 |
| 4,057,425 | 11/1977 | Lambert et al. | 430/219 |
| 4,343,893 | 8/1982 | Donald et al. | 430/401 |
| 4,416,977 | 11/1983 | Ohashi et al. | 430/611 |
| 4,416,981 | 11/1983 | Overman | 430/614 |
| 4,702,999 | 10/1987 | Ohashi et al. | 430/611 |
| 4,871,658 | 10/1989 | Sakamato et al. | 430/614 |
| 5,198,333 | 3/1993 | Dewanakele et al. | 430/611 |

FOREIGN PATENT DOCUMENTS

| | | | |
|---|---|---|---|
| 256820 | 2/1988 | European Pat. Off. | 430/614 |
| 0365926 | 10/1989 | European Pat. Off. | G03C 1/485 |
| 0421453A1 | 10/1990 | European Pat. Off. | G03C 1/035 |
| 448841 | 10/1991 | European Pat. Off. . | |
| 1906952 | 2/1969 | Germany . | |
| 1-152454 | 6/1989 | Japan | 430/614 |
| 1239017 | 7/1971 | United Kingdom | 430/611 |
| 2216279 | 2/1989 | United Kingdom | G03C 1/06 |

*Primary Examiner*—Janet C. Baxter

[57] ABSTRACT

An improved stabilizer is provided with decreased fog and minimal loss of photographic speed. The stabilizers are represented by $$A\text{-}(Y)_n\text{-}B$$

wherein;

n is 0 or 1;

Y is —S—, —$CH_2$S—, or 2,6 disubstituted pyridine with the proviso that when Y is —$CH_2$S— the substituent A is attached to the sulfur;

when Y is —S— or —$CH_2$S— A is pyrimidine, tetrazole, benzoxazole, benzimidazole, benzothiazole, benzoselenazole, naphthoxazole, or B and E separately are phenyl substituted with at least one electron accepting group or pyridine substituted with at least one electron accepting group with the proviso that when Y is —S—$CH_2$— A is not tetrazole when B is phenyl;

when Y is 2,6 disubstituted pyridine A represents hydrogen, benzoxazole, benzimidazole, benzothiazole, benzselenazole, naphthoxazole;

B represents benzoxazole, benzimidazole, benzothiazole, benzselenazole, naphthoxazole and with the provisio that when Y is S, A-$(Y)_n$-B is limited to specific components.

9 Claims, No Drawings

SILVER HALIDE EMULSIONS STABILIZED WITH IMPROVED ANTIFOGGANTS

This is a continuation of application Ser. No. 07/955,550, filed Oct. 1, 1992, now abandoned.

FIELD OF INVENTION

This invention relates to photographic silver halide emulsions and more specifically to emulsions which contain stabilizers or antifoggants. More particularly, this invention relates to emulsions which contain masked antifoggants.

BACKGROUND OF THE INVENTION

It is well known in the art to stabilize high speed photographic emulsions to inhibit the formation of fog. A host of compounds have been employed in the art of photographic science. Exemplary examples of these are azaindenes, mercaptotetrazoles, triazoles, diazoles, azoles, and the like.

Masked antifoggants are known in the art to provide an antifoggant compound which remains dormant in the coated photographic film until submersion in the development bath. During development, nucleophilic attack facilitates the release of the antifoggant whereby a relative decrease in photographic fog is observed. The unmasking reaction is taught in U.S. Pat. No. 4,343,893 to be the result of electron transfer.

There is an ongoing need to decrease the formation of fog beyond that which is obtainable from previous materials. Of particular interest is the development of electron-accepting antifoggants which are effective after long storage such as 2 years or greater. Through diligent research new electron-accepting antifoggants have been developed which provide a decrease in photographic fog and have a long storage capability.

SUMMARY OF THE INVENTION

It is an object of the present invention to provide a stabilizer for a photographic film which decreases the amount of photographic fog which is obtained during storage. A particular advantage offered by these compounds is the ability to decrease fog development without adversely affecting the photographic speed of the element. These and other advantages, as will be observed from the teachings herein are provided in a photographic element comprising a stabilizing amount of $A\text{-}(Y)_n\text{-}B$ Formula 1 wherein;

n is 0 or 1;

Y is —S—, —$CH_2$S—, or 2,6 disubstituted pyridine with the proviso that when Y is —$CH_2$S— the substituent A is attached to the sulfur;

when Y is —$CH_2$S— A is pyrimidine, tetrazole, benzoxazole, benzimidazole, benzothiazole, benzoselenazole, naphthoxazole, or

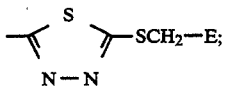

B and E separately are phenyl substituted with at least one electron accepting group or pyridine substituted with at least one electron accepting group with the proviso that when Y is —S—$CH_2$— A is not tetrazole when B is phenyl;

when Y is 2,6 disubstituted pyridine A represents hydrogen, benzoxazole, benzimidazole, benzothiazole, benzoselenazole, naphthoxazole;

B represents benzoxazole, benzimidazole, benzothiazole, benzoselenazole, naphthoxazole;

and with the provisio when Y is S $A\text{-}(Y)_n\text{-}B$ is

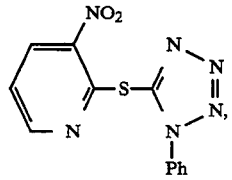

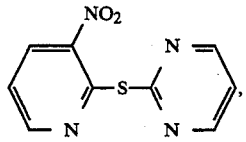

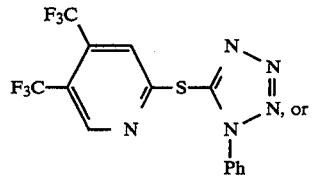

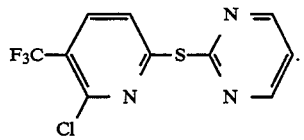

DETAILED DESCRIPTION OF THE INVENTION

Exemplary aromatic thioethers useful within the bounds of this invention include those described by Formula 1. A particularly preferred embodiment is represented by $A\text{-}SCH_2\text{-}B$ wherein;

A is pyrimidine, tetrazole, benzoxazole, benzimidazole, benzothiazole, benzoselenazole, naphthoxazole, or

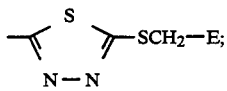

B and E separately are phenyl substituted with at least one electron accepting group or pyridine substituted with at least one electron accepting group with the proviso that A is not tetrazole when B is phenyl.

Another preferred embodiment is represented by

A-B wherein;

A is pyrimidine, tetrazole, benzoxazole, benzimidazole, benzothiazole, benzoselenazole, naphthoxazole, or

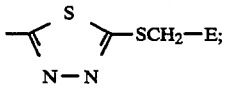

B and E separately are phenyl substituted with at least one electron accepting group or pyridine substituted with at least one electron accepting group.

Another preferred embodiment is represented by

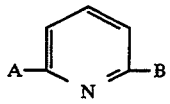

wherein

A is hydrogen, benzoxazole, benzimidazole, benzothiazole, benzoselenazole, or naphthoxazole;

B represents benzoxazole, benzimidazole, benzothiazole, benzoselenazole, or naphthoxazole.

The term "electron accepting group" refers to groups with an electronegativity greater than carbon with specifically preferred examples being nitro, fluoro, chloro and trifluoromethyl. Phenyl substituted with at least one electron accepting group refers preferably to phenyl substituted with at least one fluorine atom, at least one nitro group, at least one chloride atom or at least one trifluoromethyl group. More preferred are pentafluorophenyl, m,m'-bistrifluoromethylphenyl, nitrophenyl, m,m'-dinitrophenyl, or o,p-dinitrophenyl. Pyridine substituted with at least one electron accepting group refers preferably to pyridine substituted with at least one fluorine atom, at least one nitro group, or at least one trifluoromethyl group. More prefered is bistrifluoromethylpyridine.

It is understood that pyrimidine, tetrazole, benzoxazole, benzimidazole, benzothiazole, benzoselenazole and naphthaxazole refer to both substituted and unsubstituted as known in the art. Photographically useful salts of the heterocyclic rings are also considered within the teachings herein as exemplified by structures wherein the ring nitrogen has been alkylated and a counterion is present such as fluoroborate, borate, chloride, toluenesulfonate, bromide, iodide, thiocyanate, etc. The nomenclature is used as known in the art in accordance with the following examples:

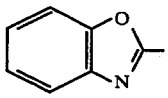

BENZOXAZOLE

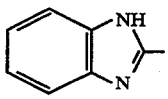

BENZIMIDAZOLE

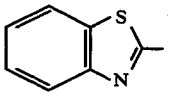

BENZOTHIAZOLE

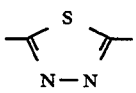

THIADIAZOLE

-continued

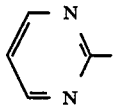

PYRIMIDINE

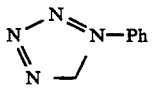

TETRAZOLE

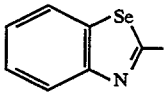

BENZOSELENAZOLE

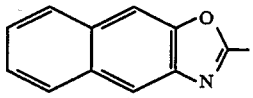

NAPTH[2,3]OXAZOLE

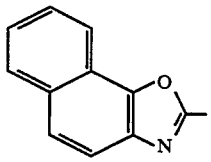

NAPHTH[2,1-d]OXAZOLE

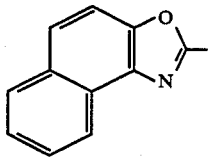

NAPHTH[1,2-d]OXAZOLE

Particularly exemplary compounds which are in accordance with the teachings of the invention described are:

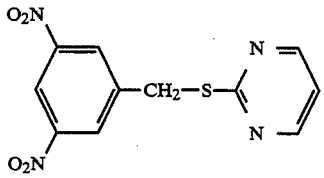

I-1

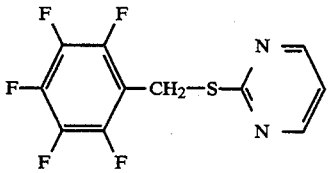

I-2

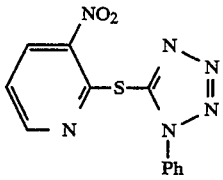

I-3

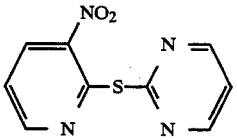

I-4

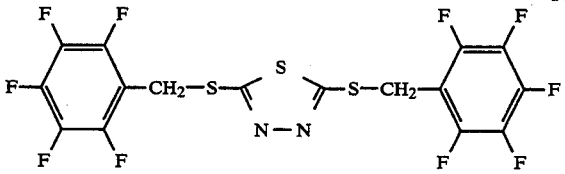

I-5

-continued
I-6
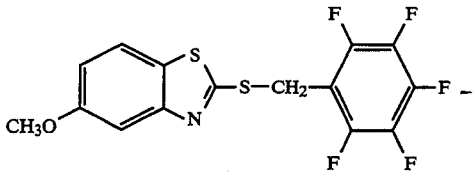
I-7
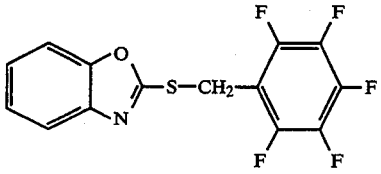
I-8
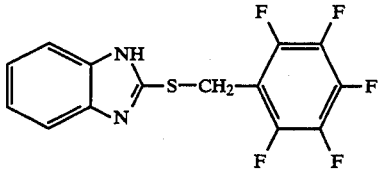
I-9
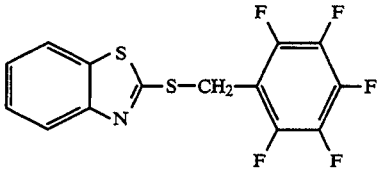
I-10
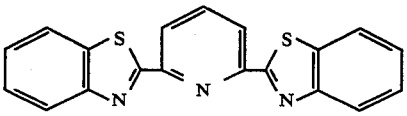
I-11
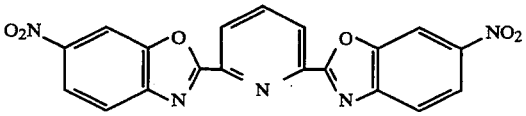
I-12
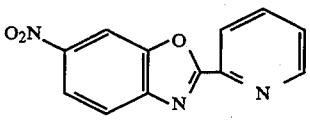
I-13
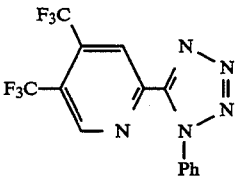
I-14
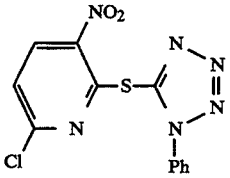
-continued
I-15
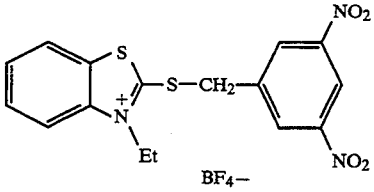
I-16
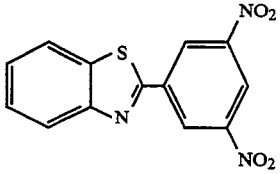
I-17
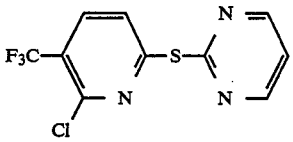
I-18
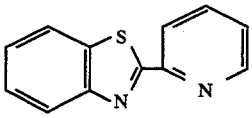
I-19
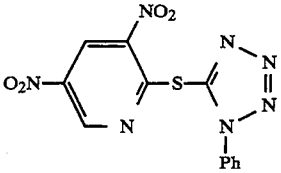
I-20
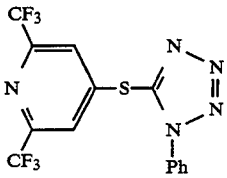
I-21
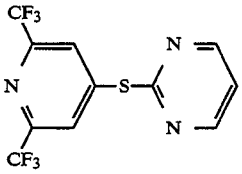
I-22
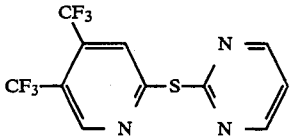
I-23
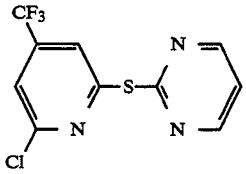

-continued

I-24

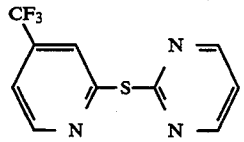

I-25

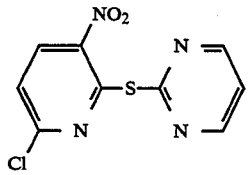

I-26

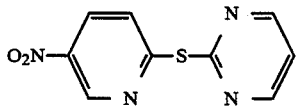

I-27

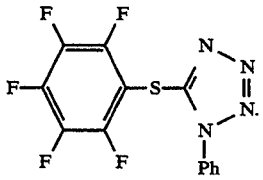

This list is not intended to limit the disclosure of the invention in any way.

The class of aromatic thioethers added to a photographic emulsion as described in these teachings acts as a stabilizer toward the development of fog during storage. These stabilizers may be added to the emulsion in a variety of means known in the art, most notably the compounds are added as a solution in an appropriate solvent. Solvents are chosen which are not deleterious to the photographic emulsion and include, but are not limited to, lower alkyl alcohols, acetone, ketones and the like. A stabilizing amount is defined as the amount at which fog is minimized with minimal loss of photographic speed. For the inventive stabilizers taught herein this amount is 0.1 to 250 mg/mole of silver halide with 0.5 to 150 mg/mole of silver halide being preferred and 1 to 100 mg/mole of silver halide being most preferable. The stabilizer can be added to a gelatino, silver halide emulsion during sensitization or just prior to coating.

The silver halide emulsion may employ any of the conventional halides but prefered are pure silver bromide or silver bromide with small amounts of iodide incorporated therein (e.g. 98% Br and 2% I by weight for example). Any grain morphology is suitable for demonstration of these teachings including, but not limited to, grains which are formed by splash techniques and those formed by techniques involving spray techniques. Tabular grains are most preferred.

Tabular grain silver halide products are well-known in the prior art with exemplary methods of manufacture described by Maskasky in U.S. Pat. No. 4,400,463; Wey, U.S. Pat. No. 4,399,205; Dickerson, U.S. Pat. No. 4,414,304; Wilgus et al., U.S. Pat. No. 4,434,226; Kofron et al., U.S. Pat. No. 4,439,520; Nottorf, U.S. Pat. No. 4,722,886; and Ellis, U.S. Pat. No. 4,801,522.

After the grains are made, it is usually preferable to disperse the grains with a binder (e.g. gelatin or other well-known binders such as polyvinyl alcohol, phthalated gelatins, etc.). In place of gelatin other natural or synthetic water-permeable organic colloid binding agents can be used as a total or partial replacement thereof. Such agents include water permeable or water-soluble polyvinyl alcohol and its derivatives, e.g., partially hydrolyzed polyvinyl acetates, polyvinyl ethers, and acetals containing a large number of extralinear —CH2HOH— groups; hydrolyzed interpolymers of vinyl acetate and unsaturated addition polymerizable compounds such as maleic anhydride, acrylic and methacrylic acid ethyl esters, and styrene. Suitable colloids of the last mentioned typed are disclosed in U.S. Pat. Nos. 2,276,322, 2,276,323 and 2,347,811. The useful polyvinyl acetals include polyvinyl acetalaldehyde acetal, polyvinyl butyraldehyde acetal and polyvinyl sodium o-sulfobinzaldehyde acetal. Other useful colloid binding agents include the poly-N-vinyllactams of Bolton U.S. Pat. No. 2,495,918, the hydrophilic copolymers of N-acrylamido alkyl betaines described in Shacklett U.S. Pat. No. 2,833,650 and hydrophilic cellulose ethers and esters. Phthalated gelatins may also be used as well as binder adjuvants useful for increasing covering power such as dextran or the modified, hydrolyzed gelatins of Rakoczy, U.S. Pat. No. 3,778,278.

It is most preferable to chemically sensitize the grain with salts that are well known in the art. The most common sensitizers are salts of gold or sulfur. Sulfur sensitizers include those which contain labile sulfur, e.g. allyl isothiocyanate, allyl diethyl thiourea, phenyl isothiocyanate and sodium thiosulfate for example. Other non-optical sensitizers such as amines as taught by Staud et al., U.S. Pat. No. 1,925,508 and Chambers et al., U.S. Pat. No. 3,026,203, and metal salts as taught by Baldsiefen, U.S. Pat. No. 2,540,086 may also be used. Spectral sensitization can also be employed to render the emulsion most sensitive to specific colors. The methods are well known in the art and include, but are not limited to, cyanines, merocyanines, oxonols, hemioxonols, styryls, merostyryls, complex cyanines and merocyanines (i.e. tri-, tetra-, and polynuclear cyanines and merocyanines), and streptocyanines as illustrated in *Research Disclosure*, No 308, December, 1989, Item 308119.

In addition to the improvements taught herein, the emulsions can contain other antifoggants, e.g. 6-nitrobenzimidazole, benzotriazole, triazaindenes, etc., as well as the usual hardeners, i.e., chrome alum, formaldehyde, dimethylol urea, mucochloric acid, etc. Other emulsion adjuvants that may be added comprise matting agents, plasticizers, toners, optical brightening agents, surfactants, image color modifiers, non-halation dyes, and covering power adjuvants among others.

The film support for the emulsion layers used in the novel process may be any suitable transparent plastic. For example, the cellulosic supports, e.g. cellulose acetate, cellulose triacetate, cellulose mixed esters, etc. may be used. Polymerized vinyl compounds, e.g., copolymerized vinyl acetate and vinyl chloride, polystyrene, and polymerized acrylates may also be mentioned. Preferred films include those formed from the polyesterification product of a dicarboxylic acid and a dihydric alcohol made according to the teachings of Alles, U.S. Pat. No. 2,779,684 and the patents referred to in the specification thereof. Other suitable supports are the polyethylene terephthalate/isophthalates of British Patent 766,290 and Canadian Patent 562,672 and those obtainable by condensing terephthalic acid and dimethyl terephthalate with propylene glycol, diethylene glycol, tetramethylene golycol or cyclohexane 1,4-dimethanol (hexahydro-p-xylene alcohol). The films of Bauer et al., U.S. Pat. No. 3,052,543 may also be used. The above polyester films are particularly suitable because of their dimensional stability.

When polyethylene terephthalate is manufactured for use as a photographic support, the polymer is east as a film, the mixed polymer subbing composition of Rawlins, U.S. Pat. No. 3,567,452 is applied and the structure is then biaxially stretched, followed by application of a gelatin subbing layer. Alternatively, antistatic layers can be incorporated as illustrated, for example, by Miller, U.S. Pat. Nos. 4,916,011 and 4,701,403, Cho, U.S. Pat. Nos. 4,891,308 and 4,585,730 and Schadt, U.S. Pat. No. 4,225,665. Upon completion of stretching and application of subbing composition, it is necessary to remove strain and tension in the base by a heat treatment comparable to the annealing of glass.

The emulsions may be coated on the supports mentioned above as a single layer or multi-layer element. For medical x-ray applications, for example, layers may be coated on both sides of the support which conventionally contains a dye to impart a blue tint thereto. Contigous to the emulsion layers it is conventional, and preferable, to apply a thin stratum of hardened gelatin supra to said emulsion to provide protection thereto.

The following specific examples are provided as reference and are not intended to limit the invention in any way.

SYNTHETIC EXAMPLES

Standard organic synthetic procedures may be employed for preparation of the compounds as taught herein. The following synthetic procedures are provided as suitable for preparing the compounds of the current invention. Alternate procedures may also be employed as known in the art without deleterious results. Preparation of compounds not specifically recited can be synthesized in a manner directly analogous to the representative compounds as known to one skilled in the art.

2-(2,3,4,5,6-Pentafluorobenzylthio)pyrimidine (I-2)

To a mixture of 0.47 g of 2-mercapto-pyrimidine in 15 ml 95% ethanol was added 0.18 g of NaOH. The mixture was stirred 45 min. until an amber solution resulted; then 1 g of 2,3,4,5,6-pentafluorobenzyl bromide was added. The adduct precipitated within five minutes. Stirring continued for one hour. Filtration of the mixture yielded 0.26 g, mp 89°–92° C.

2-(2,3,4,5,6-Pentafluorobenzylthio)benzothiazole (I-9)

To a slurry of 1.67 g of the 2-mercaptobenzothiazole in 18 ml of hot 95% ethanol was added 0.4 g of sodium hydroxide. After all materials had dissolved, the mixture was added to 2.79 g of 2,3,4,5,6-pentafluorobenzyl bromide. The mixture was stirred at 30°–32° C. for 1 minute, then poured into 75 ml ice-water. The product precipitated, was filtered and dried to yield 3.21 g, mp 58°–59.5° C. Recrystallization from aqueous ethanol yielded 2.19 g, mp 51°–53° C.

2-(2,3,4,5,6-Pentafluorobenzylthio)benzimidazole (I-8)

To a slurry of 1.50 g of the 2-mercaptobenzimidazole in 28.5 ml of 95% ethanol was added 0.4 g of sodium hydroxide. After all materials had dissolved, the mixture was added to 2.80 g of 2,3,4,5,6-pentafluorobenzyl bromide. The mixture was stirred at 28°–32° C. for 1 hr, then poured into 150 ml water. The product precipitated, was filtered and dried to yield 2.50 g, mp 189°–196° C. Recrystallization from aqueous methanol yielded 1.95 g, mp 193°–195° C.

2-(2,3,4,5,6-Pentafluorobenzylthio)benzoxazole (I-7)

To a slurry of 1.51 g of the 2-mercaptobenzoxazole in 8 ml of 95% ethanol was added 0.4 g of sodium hydroxide. After all materials had dissolved, the mixture was filtered into 3.80 g of 2,3,4,5,6-pentafluorobenzyl bromide. The mixture was stirred at 28°–29° C. for 50 min., then poured into100 ml ice-water. The product precipitated, was filtered and dried to yield 2.41 g, mp 85°–87.5° C. Recrystallization from aqueous acetone yielded 1.83 g, mp 84°–86° C.

Bis-2,5-(2,3,4,5,6-pentafluorobenzylthio)1,3,4-thiadiazole (I-5)

2,5-Dimercapto-1,3,4-thiadiazole, dipotassium salt (2.26 g) was dissolved in 63% aqueous ethanol and filtered into 3.13 g of 2,3,4,5,6-pentafluorobenzyl bromide. The mixture was stirred at 27°–28° C. for 29 min., then poured into 100 ml ice-water. The product precipitated, was filtered and dried to yield 2.35 g, mp 112°–116° C. Recrystallization from aqueous methanol yielded 2.11 g, mp 113°–115° C.

5-Methoxy-2-(2,3,4,5,6-pentafluorobenzylthio)benzothiazole (I-6)

To a slurry of 1.98 g of the 2-mercaptobenzimidazole in 35 ml of hot 95% ethanol was added 0.4 g of sodium hydroxide. After all materials had dissolved, the mixture was added to 2.89 g of 2,3,4,5,6-pentafluorobenzyl bromide. The mixture was stirred at 26°–31° C. for 12 min., then poured into 150 ml ice-water. The product precipitated, was filtered and dried to yield 3.72 g, mp 71°–75° C. Recrystallization from methanol yielded 3.21 g, mp 74°–76° C.

2-(2-Pyrimidinylthio)-3-nitropyridine (1-4)

A mixture of 2.8 g of 2-mercaptopyrimidine in 35 ml 5.5% aqueous sodium hydroxide solution was added to 3.95 g 2-chloro-3-nitropyridine in 15 ml DMSO that was preheated to 92° C. The mixture, already containing precipitated product, cooled, and then was reheated to reflux at 82° C. After one hour, the reaction was allowed to cool and then poured into 150 ml ice-water. The precipitate was collected by filtration, washed with water and 95% ethanol, and then recrystallized from 95% ethanol to give 4.34 g (74% yield), mp 122.5°–124° C.

2-[2-(1-Phenyltetrazolo)]-3-nitropyridine (I-3)

A solution of 11.55 g of 2-chloro-3-nitropyridine in 45 ml DMSO was heated to 75° C. A solution of 14.6 g of the sodium salt of 1-phenyl-2-mercaptotetrazole in 45 ml 95% ethanol was added. Within six minutes, the solution hazed. The mixture was heated to reflux 2.5 hrs., then cooled and poured into 600 ml water. The resulting precipitate was collected, water washed, and then slurried in hot acetone to give 13.38 g, mp 175°–176° C.

6-Chloro-2-[2-pyrimidinyl]-5-trifluoromethylpyridine (I-17)

The sodium salt 2-mercapto-pyrimidine was prepared from sodium hydroxide and 2-mercaptopyrimidine in DMSO. This was added to 2,6-dichloro-3-trifluoromethylpyridine. The mixture heated to 60°–87° C. for 100 min. The mixture was cooled, poured into ice-water, filtered, washed with water, and dried to yield 2.73 g, mp 118°–132.5° C. Recrystallization from methanol yielded 1.86 g, mp 146°–148° C.

2-[2-(1-Phenyltetrazolo)]-4,5-bis(trifluoromethyl)pyridine (I-13)

The sodium salt of 1-phenyl-2-mercaptotetrazole (2.00 g) was dissolved in 8 ml DMSO. This was added to 2-chloro-4,5-bis(trifluoromethyl)pyridine that had been preheated to 70° C. The mixture was heated to 100°–103° C. for 90 min. The mixture was cooled, poured into water, filtered, washed with water, and dried to yield 2.80 g, mp 88°–92.5° C. Recrystallization from aqueous ethanol yielded 2.04 g, mp 99°–101° C.

Bis-2,6-(2-benzothiazolyl)pyridine (I-10)

Dipicolinic acid (8.70 g, 0.052 mol) was mixed with 140 ml polyphosphoric acid and heated to 180° C. o-Aminothiophenol (10.4 ml) was added and reaction maintained between 180°–208° C. for 2.5 hrs. The mixture was quenched with 600 ml ice-water, neutralized with KOH, cooled, and filtered. The product was washed with methanol, then recrystallized from pyridine to give 16.91 g, mp 272°–275° C.

2-(3,5-Dinitrophenyl)benzothiazole (I-1)

3,5-Dinitrobenzoic acid (5.30 g) was mixed with 40 ml polyphosphoric acid and heated to 64° C. o-Aminothiophenol (2.5 ml) was added and reaction maintained to 150° C. over 0.5 hr period. The mixture was quenched with 600 ml ice-water, neutralized with KOH, cooled, and filtered. The product yield was 3.20 g, mp 73.5°–84.5° C.

EMULSION EXAMPLES

Photographic films containing various amounts of the compounds of this invention were prepared using a standard high speed gold- and sulfur-sensitized gelatino-silver iodobromide emulsion.

A large sample of the stock emulsion was divided into smaller samples containing 0.15 moles of silver halide. Immediately after cessation of sensitization the antifoggants were added as a alcohol solution in the amounts indicated in the Tables. Control samples were prepared with prior art antifoggants in a manner identical to the inventive examples. The emulsions were coated as known in the art on a gel-subbed polyethylene terephthalate film base to an average coating weight of 2.7 g Ag/m2. Supra to the emulsion a standard protective overcoat was applied which consisted of a thin layer of gelatin hardened with chrome alum and formaldehyde.

The samples were flashed through a standard $\sqrt{2}$ step wedge using a Dupont Electro-Luminescent exposure device. Sensitometric parameters were measured as known in the art and reported on a relative scale to facilitate comparisons. The exposed strips were developed and fixed using a standard medical x-ray processor and chemicals.

Throughout the following examples B+F represents the density of the support plus that density which occurs in an unexposed sample. ODF represents overdevelopment fog which corresponds to the base density plus the fog which occurs from development at 40.5° C. Safelight fog is reported as the increase in density which results from a 2 minute exposure to a 15 Watt bulb filtered by a standard GBX-II safelight filter at 24 inches.

EXAMPLE 1

A typical, high speed, spherical grain, silver bromoiodide X-ray type emulsion was prepared. This emulsion was dispersed in photographic grade gelatin and then brought to optimum sensitivity with gold and sulfur salts as is well-known to those skilled in the art. The emulsion was then stabilized by the addition of 4-hydroxy-6-methyl-1,3,3a,7-tetraazaindene and 1-phenyl-5-mercaptotetrazole. The usual wetting agents, antifoggants, coating aids, and hardeners were added. The compounds of this invention were then added as a methanol solution. This emulsion was then coated on a dimensionally stable, 7 mil polyethylene terephthalate film support which had first been coated with a conventional resin sub followed by a thin substratum of hardened gelatin applied supra thereto. After coating, a thin abrasion layer of hardened gelatin was applied over the emulsion layer. For control purposes, a similar emulsion was made without the compounds of this invention or with comparative compound C-1 from the prior art.

C-1

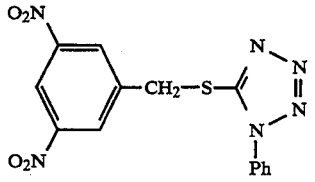

Samples of each of these coatings were given a conventional X-ray exposure with a conventional X-ray intensifying screen and a conventional $\sqrt{2}$ step wedge. The samples were then developed in a conventional x-ray film processor. Alternatively, a white-light exposure was made with ELS sensitometer. Repeated samples represent a retest of an identically prepared sample.

TABLE 1

| compound | amount mg/mole Ag | fresh B + F | fresh speed | fresh ODF | 2-years age B + F | 2-years age speed |
|---|---|---|---|---|---|---|
| control | — | .167 | 100 | .204 | .213 | 91 |
| control | — | .158 | 111 | .273 | .207 | 100 |
| C-1 | 20.00 | .160 | 98 | .180 | .198 | 84 |
| I-1 | 13.33 | .153 | 100 | .17 | .193 | 82 |
| I-1 | 26.66 | .148 | 109 | .19 | .204 | 96 |
| I-2 | 13.33 | .152 | 97 | .161 | .187 | 83 |
| I-2 | 26.66 | .150 | 99 | .168 | .183 | 89 |
| I-2 | 40.00 | .148 | 97 | .166 | .167 | 84 |

The compounds of this invention clearly show benefit by reduction of fresh, over-development fog (ODF), and two-year aging fog (B+F) with minimal loss of photographic speed.

EXAMPLE 2

An emulsion was prepared as described in Example 1, but with addition of the compounds shown in Table 2.

TABLE 2

| Compound | Amount mg/mole Ag | Fresh B + F | Fresh ODF | 6 Months B + F | 24 Months B + F |
|---|---|---|---|---|---|
| Control | — | .18 | .212 | .198 | .245 |
| C-1 | 20.00 | .16 | .214 | .183 | .242 |
| I-3 | 13.33 | .17 | .204 | .184 | .236 |
| I-3 | 26.66 | .16 | .195 | .182 | .229 |
| I-4 | 26.66 | .16 | .193 | .184 | .228 |
| I-4 | 40.00 | .15 | .187 | .181 | .223 |

The compounds of this invention show reduction in fog build during storage. Both the control and the prior art compound represented by C-1 have a higher increase in fog than the compounds of the current invention.

EXAMPLE 3, 4, 5, 6 AND 7

A silver bromide tabular grain emulsion was made according to the teachings of Ellis, U.S. Pat. No. 4,801,522. After precipitation of the grains, the average aspect ratio was determined to be about 5:1 and thickness of about 0.2 μm. These grains were dispersed in photographic gelatin (about 117 grams gelatin/mole of silver bromide) and a solution of 250 mg dye A and 161 mg tributylamine in 2.9 ml of methanol was added to achieve 150–217 mg of dye per mole of silver halide. The emulsion was sensitized, stabilized, and coated as in Example 1. The sensitometry reported is within the first week after coating. The results presented in each of the Tables 3 through Table 7 represent separate independent evaluations of the inventive samples.

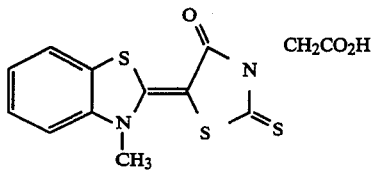

Dye A

TABLE 3

| Compound | Amount mg/mole Ag | B + F | Speed |
|---|---|---|---|
| control | — | .165 | 100 |
| C-1 | 10.4 | .162 | 103 |
| I-13 | 180 | .153 | 107 |
| I-4 | 7.5 | .155 | 102 |

TABLE 4

| Compound | Amount mg/mole Ag | B + F | Speed |
|---|---|---|---|
| Control | — | .150 | 100 |
| C-1 | 10.4 | .148 | 98 |
| I-14 | 3.3 | .141 | 98 |

TABLE 5

| Compound | Amount mg/mole Ag | B + F | SPEED | Δ Safelight Fog (2 min exposure) |
|---|---|---|---|---|
| Control | — | .159 | 100 | .29 |
| C-1 | 20.0 | .154 | 95 | .21 |
| I-10 | 100 | .158 | 94 | .18 |
| I-5 | 33 | .155 | 93 | .19 |
| I-5 | 100 | .154 | 98 | .20 |
| I-6 | 3.3 | .158 | 98 | .16 |
| I-6 | 33 | .152 | 96 | .17 |

TABLE 6

| Compound | Amount mg/mole Ag | B + F | SPEED |
|---|---|---|---|
| control | — | .175 | 100 |
| C-1 | 20.0 | .14 | 90 |
| I-15 | 0.33 | .153 | 102 |
| I-15 | 0.66 | .150 | 96 |
| I-16 | 0.33 | .146 | 95 |

TABLE 7

| Compound | Amount mg/mole Ag | B + F | SPEED |
|---|---|---|---|
| control | — | .190 | 100 |
| C-1 | 20.0 | .157 | 97 |
| I-14 | 13.3 | .150 | 87 |
| I-13 | 0.67 | .154 | 101 |
| I-4 | 0.67 | .155 | 101 |
| I-17 | 100 | .153 | 101 |
| I-7 | 3.3 | .153 | 99 |
| I-9 | 3.3 | .153 | 98 |
| I-8 | 3.3 | .158 | 100 |

The compounds of this invention shown in Table 5 demonstrate improved performance against red safelight fog while showing no adverse effect on speed and B+F. As illustrated in the Tables the inventive examples decrease the fog without significantly decreasing the photographic speed of the film.

What is claimed:

1. A photographic element comprising a stabilizing amount of at least one compound chosen from ii, iii, iv, v and vi;

$A^1$-$B^1$(ii)

wherein;

$A^1$ represents pyrimidine, benzoxazole, benzothiazole, benzoselenazole, naphthoxazole, or

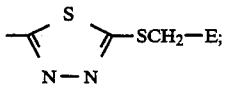

$B^1$ represents a pyridine, substituted with at least one electron accepting group;

E represents a phenyl, substituted with at least one electron accepting group, or pyridine substituted with at least one electron accepting group;

$A^2$-$SCH_2$-$B^2$(iii)

$A^2$ represents benzoselenazole, naphthoxazole, or

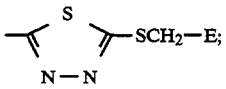

$B^2$ represents a pyridine substituted with at least one electron accepting group;

E is as defined above;

$A^3$-$SCH_2$-$B^3$(iv)

$A^3$ represents pyrimidine, tetrazole, benzoxazole, benzimidazole, or benzothiazole;

$B^3$ represents a pyridine substituted with at least one electron accepting group chosen from the group consisting of nitro and trifluoromethyl;

(v)

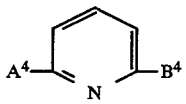

$A^4$ represents benzoxazole, benzothiazole, benzoselenazole, or naphthoxazole;

$B^4$ represents benzoxazole, benzimidazole, benzothiazole, benzoselenazole, or naphthoxazole;

$A^5$-S-$B^5$(vi)

wherein $A^5$ and $B^5$ are the groups necessary to obtain the compounds chosen from the set consisting of:

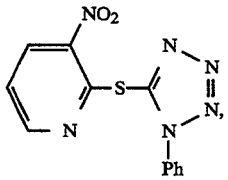

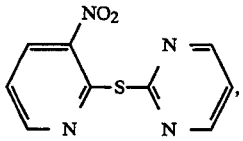

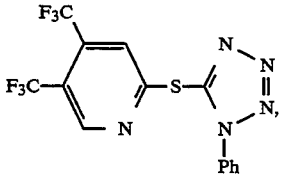

and

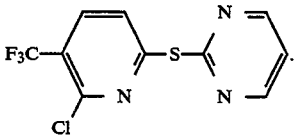

2. The photographic element recited in claim 1 comprising

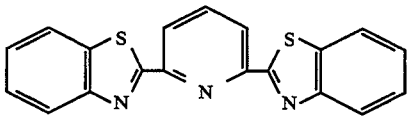

or

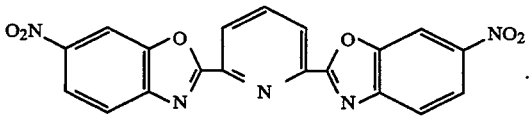

3. The photographic element recited in claim 1 comprising a stabilizing amount of

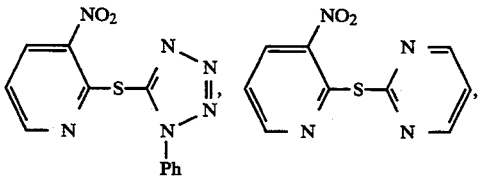

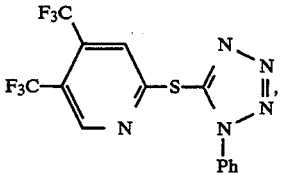

or

-continued

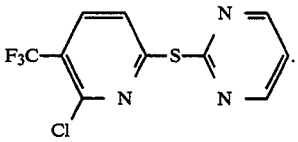

4. The photographic element recited in claim 1 comprising:

$A^2$-$SCH_2$-$B^2$ $A^2$ represents benzoselenazole, naphthoxazole, or

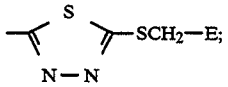

$B^2$ represents a pyridine substituted with at least one electron accepting group;

E is as defined above; or $A^3$-$SCH_2$-$B^3$ $A^3$ represents pyrimidine, tetrazole, benzoxazole, benzimidazole, or benzothiazole;

$B^3$ represents a pyridine substituted with at least one electron accepting group chosen from the group consisting of nitro and trifluoromethyl.

5. The photographic element recited in claim 4 wherein $B^2$ represents a pyridine substituted with at least one compound chosen from the set consisting of a fluorine atom, a nitro group, a chlorine atom and trifluoromethyl.

6. The photographic element recited in claim 4 comprising

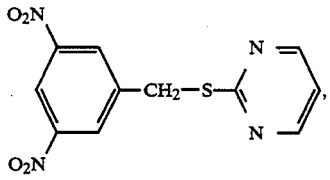

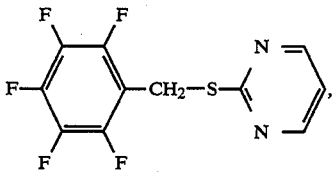

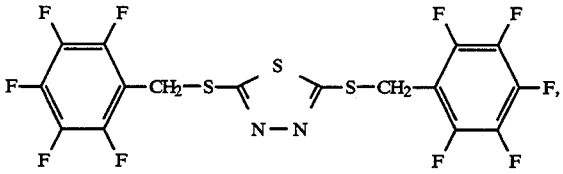

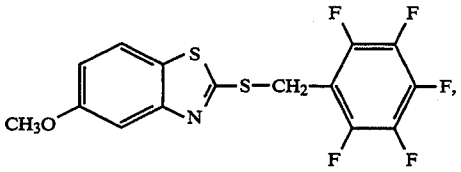

-continued

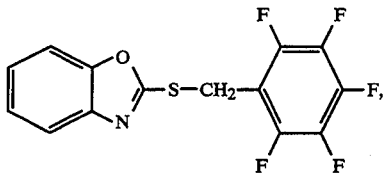

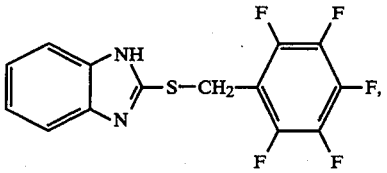

or

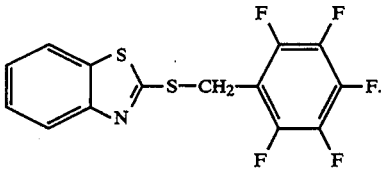

7. The photographic element recited in claim 1 comprising

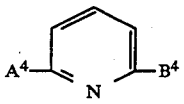

$A^4$ represents benzoxazole, benzothiazole, benzoselenazole, or naphthoxazole;

$B^4$ represents benzoxazole, benzimidazole, benzothiazole, benzoselenazole, or naphthoxazole.

8. A photographic element comprising a stabilizing amount of

A-B wherein;

A represents pyrimidine, benzoxazol, benzoselenazole, naphthoxazole, or

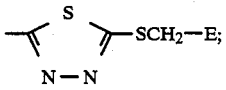

B represents a phenyl, substituted with at least one electron accepting group;

E represents a phenyl, substituted with at least one electron accepting group, or pyridine substituted with at least one electron accepting group.

9. A photographic element comprising a stabilizing amount of at least one compound chosen from the set consisting of:

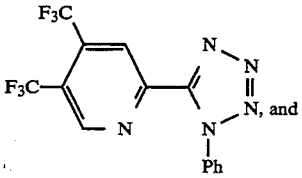

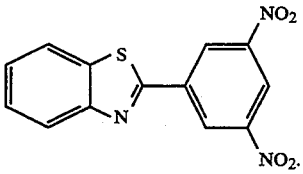

* * * * *